US007447450B2

(12) United States Patent
Takahashi

(10) Patent No.: US 7,447,450 B2
(45) Date of Patent: Nov. 4, 2008

(54) IMAGE FORMING DEVICE WITH A COLOR DETECTION APPARATUS

(75) Inventor: Masayoshi Takahashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 394 days.

(21) Appl. No.: 11/259,192

(22) Filed: Oct. 27, 2005

(65) Prior Publication Data

US 2007/0098421 A1 May 3, 2007

(51) Int. Cl.
*G03G 15/00* (2006.01)

(52) U.S. Cl. ..... 399/44

(58) Field of Classification Search ..... 399/44, 399/97

See application file for complete search history.

(56) References Cited

U.S. PATENT DOCUMENTS 6,568,780 B2 * 5/2003 Schantz et al. ..... 347/14

2003/0044190 A1 * 3/2003 Nakayama ..... 399/49

FOREIGN PATENT DOCUMENTS

JP 08-166726 * 6/1996

* cited by examiner

*Primary Examiner*—Sandra L Brase
(74) *Attorney, Agent, or Firm*—Global IP Counselors, LLP

(57) ABSTRACT

The present invention is an image forming device in which the conditions for specific processes are changed in accordance with the humidity. The present invention includes a colored material whose color changes with humidity, a detection device that detects the color of the colored material, and a control device that changes the conditions of specific processes in accordance with the color. In this way an image forming device can be provided that forms good images without transfer or separation defects and at a low cost.

4 Claims, 4 Drawing Sheets

IMAGE FORMING DEVICE WITH A COLOR DETECTION APPARATUS

FIELD OF THE INVENTION

The present invention relates to an image forming device such as a copier, printer, facsimile machine, and more particularly to an image forming device in which the conditions for specific processes are changed in accordance with the humidity.

BACKGROUND INFORMATION

The moisture content of sheets housed in the sheet supply cassette and similar locations varies depending upon the installation environment of an image forming device and the season. If the moisture content of the sheets is greater than a specific value, many types of problems have occurred, such as voiding and other transfer defects, and defects in separation from the photosensitive drum.

As a countermeasure to this, conventionally heaters have been provided within the image forming device or sheet supply cassette, etc., in order to reduce the moisture content of the sheets by the heat of the heaters. However, although this countermeasure is effective for sheets in the sheet supply cassette within the image forming device, it is not effective for sheets on the manual feed tray outside the main body of the image forming device.

Therefore image forming devices as described below are known.

The image forming device A as shown in FIG. 3 includes a scanner unit B as image reading means for reading the image information of original documents, an image forming unit C as image forming means, and a sheets deck D. The scanner unit B includes a scanning system light source 201, a platen glass 202, a document pressure plate 203 that can open and close with respect to the main body of the image forming device, a mirror 204, a lens 205, a light receiving element (photoelectric transducer) 206, and an image processing unit (not shown in the drawings).

A book or sheet is placed face down on the platen glass 202, then with the document pressure plate 203 pressing against the rear surface a reading start key (not shown in the drawing) is pressed. This causes the scanning system light source 201 to scan the underside of the platen glass 202 in the direction of the arrow "a" to read the image information on the document surface. Document image information read by the scanning system light source 201 in this way is processed in the image processing unit, converted to electrical signals, and transmitted to a laser scanner 111.

A sheet supply cassette (internal loading unit) 1 is provided below the image forming unit C. The sheet supply cassette 1 comprises a lower cassette 1*a* and an upper cassette 1*b* forming a single sheet supply unit. Here three sheet supply units, U1, U2, and U3, are provided. The highest sheet supply unit U1 is detachably installed on the main body of the device A, and the other two sheet supply units U2, U3, are detachably installed on the sheet deck D.

Sheets contained in cassettes 1*a*, 1*b* are fed out by a pick up roller 3, and after separating and feeding one sheet at a time by the cooperative action of a feed roller 4 and a retard roller 5, one sheet is fed by a pair of feed rollers 104, 105 as far as a pair of stationary register rollers 106. Then the sheet is fed to a transfer unit between a photosensitive drum 112 and a transfer roller 115 at a predetermined timing by the rotation of the pair of register rollers 106.

Also, the side of main body of the device A includes a manual feed tray (external loading unit) 10. Sheets S loaded in the manual feed tray 10 are fed by a manual sheet supply roller 11, and transported to the pair of stationary register rollers 106.

The image forming unit C includes a photosensitive drum (image carrying body) 112, an image writing optical system 113, a developer 114, and a transfer roller 115. The surface of the photosensitive drum 112 is uniformly charged by a primary charger (not shown in the drawings). The surface of the photosensitive drum 112 is then scanned by the image writing optical system 113 with laser light corresponding to the image information emitted from the laser scanner 111, to form a latent image. The latent image is developed into a toner image by the developer 114, and transferred to the sheet S passing through the transfer unit by the transfer roller 115.

The sheet S onto which the toner image is transferred is transported to a fixing device 118 by a transfer belt 117. Then the toner image is heated and subject to pressure while passing through the fixing device 118 and fixed onto the surface of the sheet. After fixing, the sheet S is output to a sheet output tray 120 outside the image forming device by a pair of output rollers 119.

To form an image on both sides of the sheet S, the sheet S is held by the pair of output rollers 119 after it has passed the fixing device 118, and when the rear edge of the sheet S has passed a branch point 207 the pair of output rollers 119 reverses. As a result of this the sheet S is temporarily placed in a double-sided tray 121. Then the sheet S is transported by the pair of feed rollers 104, 105 to the stationary pair of register rollers 106. Then the image is formed on the second side of the inverted sheet S in the same way as described above, and output to the sheet output tray 120.

The image forming device has the following characteristics.

A humidity sensor 300 is provided within the main body of the image forming device A. The humidity sensor 300 is provided within the image forming device A on the side wall that contains the manual feed sheet supply unit, and measures the humidity of air taken in through slits 301 (FIG. 4) on the side wall. When the manual feed tray 10 is open (FIG. 3) the humidity sensor 300 is directly above the manual feed tray 10, so the humidity of the air that affects the sheets S in the manual feed tray can be measured.

The humidity information measured by the humidity sensor 300 is sent to a CPU (control means) 400. Then based upon the humidity information the CPU 400 sets the transfer bias to the sheet S and the separation voltage from the photosensitive drum 112 to the sheet S.

As described above, according to the image forming device the moisture absorption of the sheets is measured, then the transfer bias and the separation voltage are set in accordance with the moisture absorption. Therefore image forming can be carried out without transfer and separation defects.

In this image forming device humidity is measured by a humidity sensor, which has the advantage that measurements are highly accurate, but it has the disadvantage that the cost is high. In other words, for setting the transfer bias and separation voltage it is sufficient to know the humidity approximately, so a cheaper mechanism for detecting the humidity is desirable.

The present invention is proposed based upon the conventional situation as described above, and it is an object to provide an image forming device at low cost that is capable of forming good images without transfer and separation defects.

SUMMARY OF THE INVENTION

The present invention adopts the following means to achieve the object described above.

The present invention is an image forming device that changes the conditions for specific processes in accordance with the humidity. The present invention includes a colored material that changes color in accordance with the humidity, detection means for detecting the color of the colored material, and control means for changing the conditions of specific processes in accordance with the color. In this way an image forming device that is capable of forming good images without transfer and separation defects can be provided at low cost.

It is desirable that the colored material is provided between the position for reading the white standard plate and the original document irradiation position. As means for detecting the color of the colored material, a CCD line sensor capable of reading color can be used.

According to the present invention, an image forming device capable of forming good images without transfer and separation defects can be provided at low cost.

DETAILED DESCRIPTION OF THE PREFERRED EMBODIMENTS

The following is a detailed explanation of a preferred embodiment of the present invention in accordance with the drawings.

Figure 1:
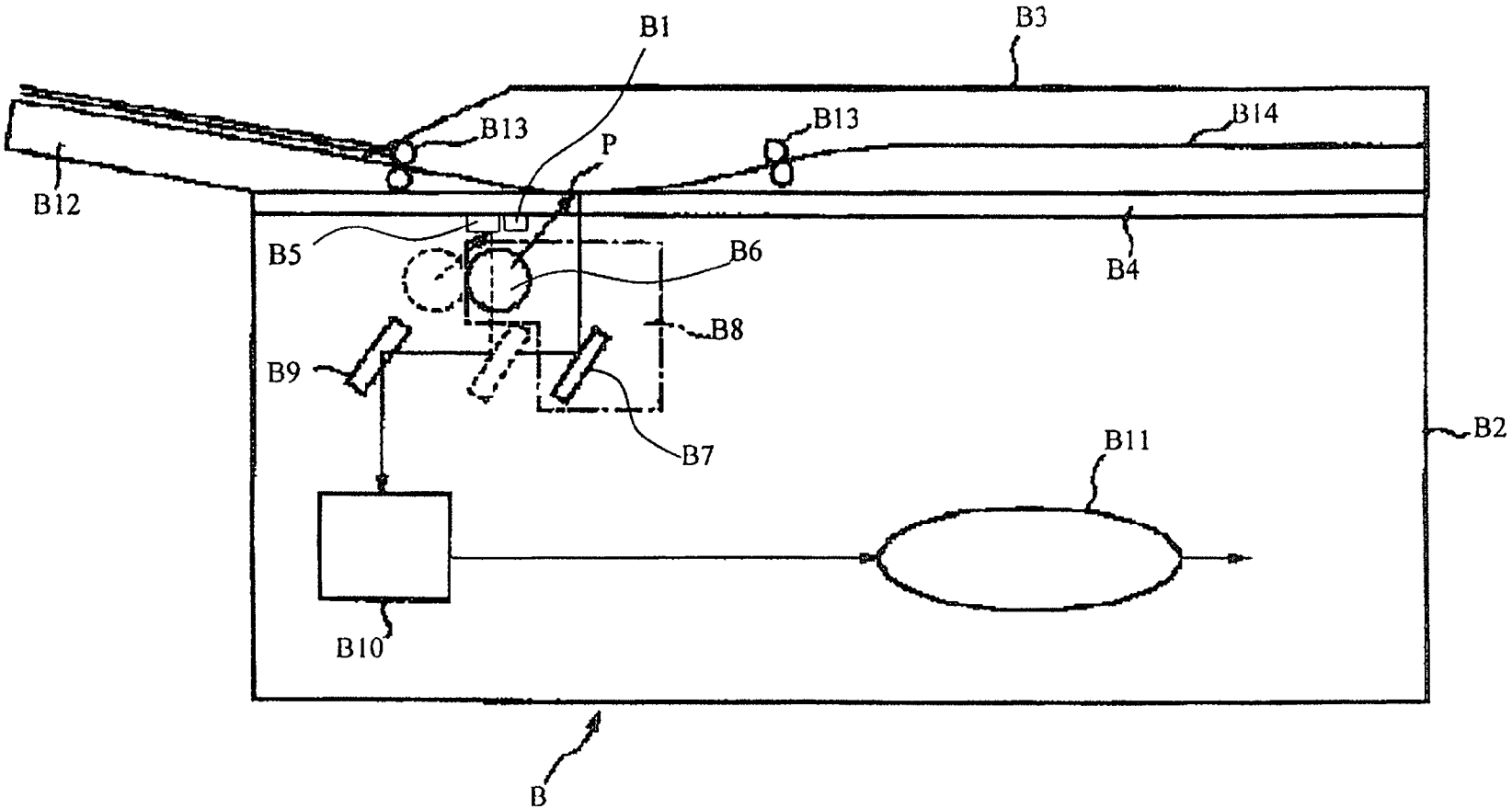
FIG. 1 is an outline of the scanner unit of an image forming device according to the present invention.

FIG. 1 is an outline of a scanner unit B of an image forming device according to the present invention. The scanner unit B includes a sheet feeder type automatic supply device B3 and a main body B2 that houses the reading optical system.

The automatic supply device B3 includes an original document loading platform B12 in which a plurality of documents are loaded, and a feed mechanism such as a roller B13 for feeding documents loaded in the original document loading platform B12 one sheet at a time. Sheets fed in this way are output to a tray B14.

A transparent glass B4 is provided on the top surface of the main body B2. A white standard plate (shading correction plate) B5 with known reflectivity is provided on the lower left end of the glass B4, and the original document irradiation position P is at the top surface of the glass B4 to the right of the white standard plate B5.

A lamp B6 for light exposure and a carriage B8 on which a mirror B7 is mounted are provided inside the main body B2 capable of moving in the direction of feeding the documents. The position of irradiation of the lamp B6 is capable of moving between the reading position of the white standard plate B5 and the original document reading position P by movement of the carriage B8. In FIG. 1 the broken lines indicate the lamp B6 irradiating the reading position of the white standard plate B5, and solid lines indicate the lamp B6 irradiating the original document irradiation position P.

Also, a mirror B9 and a CCD line sensor B10 capable of reading colors are provided inside the main body B2. The mirror B9 is fixed to the main body B2, so reflected light from either the white standard plate B5 or the original document is led to the CCD line sensor B10 via the mirrors B7, B9 and an imaging lens (not shown in the drawings).

The CCD line sensor B10 carries out photoelectric conversion of the incident light and outputs an electrical signal. The electrical signal output from the CCD line sensor B10 is supplied to a signal processing unit B11, where amplification, A/D conversion, shading correction, and other processes are carried out by the signal processing unit B11.

In the present invention, paper B1 impregnated with cobalt chloride, ferric ammonium alum, or similar colored material is provided between the reading position of the white standard plate B5 and the original document irradiation position P. In this way, when the irradiation position of the lamp B6 moves from the reading position of the white standard plate B5 to the original document irradiation position P, light reflected from the paper B1 impregnated with the colored material is fed to the CCD line sensor B1O.

Cobalt chloride is blue in the dry condition, but changes to red when moisture is absorbed. Therefore approximate humidity information can be obtained by detecting the color of the paper B1 impregnated with the colored material. Based upon this humidity information, the CPU (control means) sets the transfer bias and separation voltage in the same way as conventional art described above.

In this way, by the simple device of detecting the color of paper impregnated with colored material, the present invention is capable of forming good images without transfer and separation defects. Furthermore, the paper impregnated with colored material is provided between the reading position of the white standard plate and the original document irradiation position, so the existing CCD line sensor can be used as means for detecting the color of the paper, which has the merit of lower cost.

The position for providing the paper B1 impregnated with colored material is not limited to the position described above. It is desirable that the paper B1 impregnated with colored material is in a position where it can be read by the existing CCD line sensor. However, the effect of the present invention can be obtained if color detection means is provided similar to the sensor.

Also, paper impregnated with colored material is used here, but the present invention is not limited to paper impregnated with colored material. The material in which the colored material is impregnated does not have to be paper.

Also, the present invention has been explained applied to an image forming device in which the carriage B8 is fixed at the original document irradiation position P, and the original document is read when it passes the original document irradiation position P as shown in FIG. 1. However, the present invention can also be applied to image forming devices with original document reading configurations other than that shown in FIG. 1.

Figure 2:
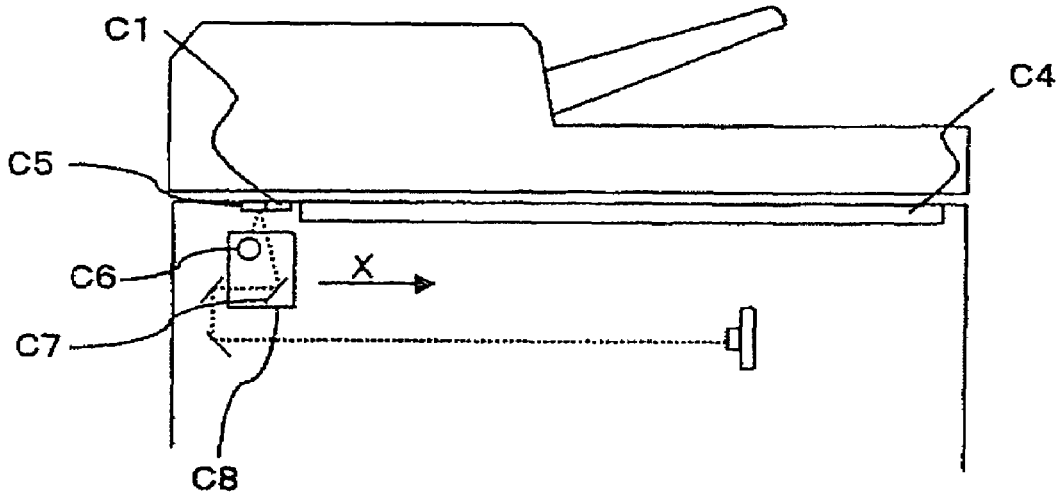
FIG. 2 is an outline of the scanner unit of an image forming device according to the present invention.
Figure 3:
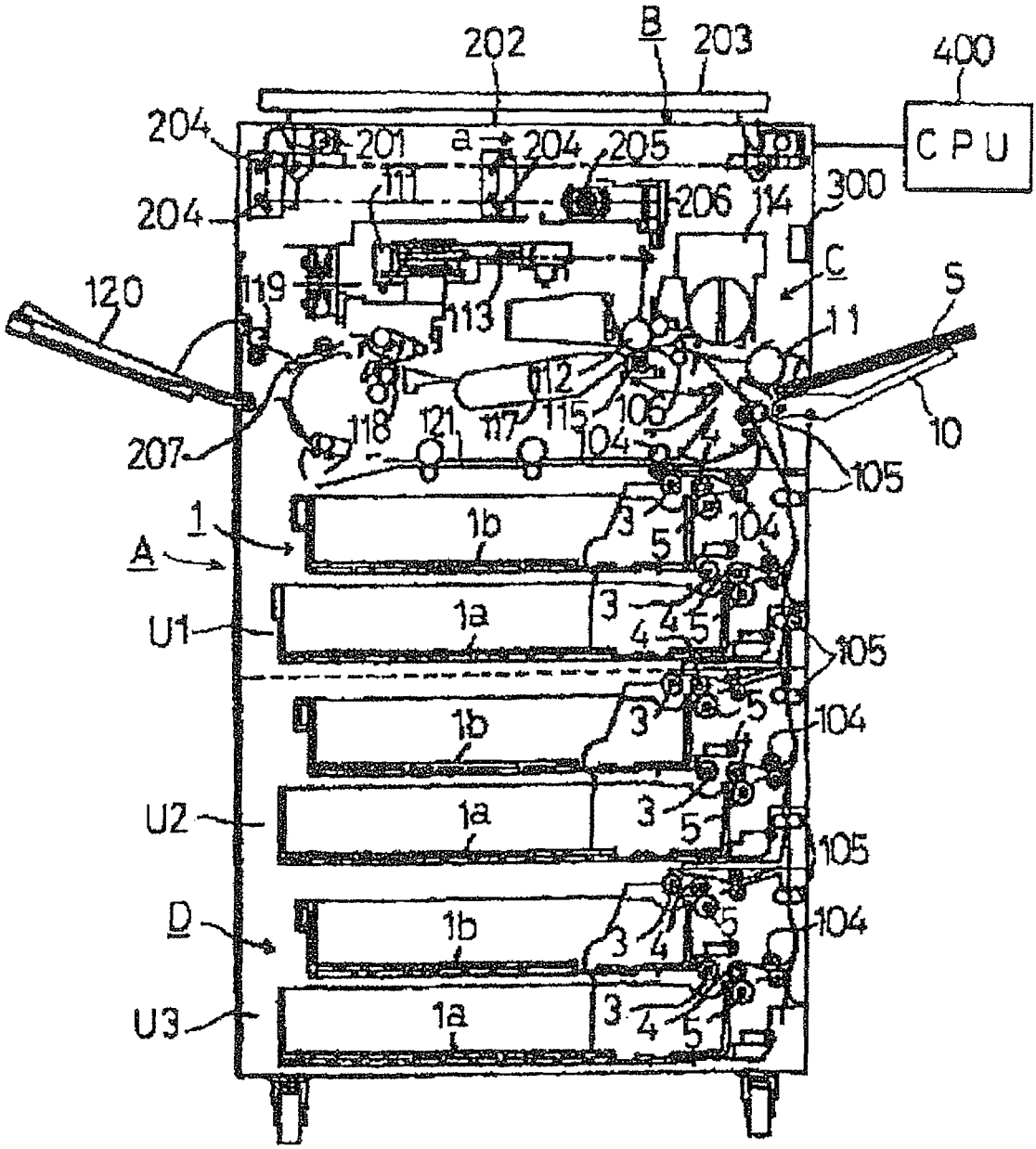
(Prior Art) Fig. 3
FIG. 3 is a figure explaining an image forming device according to conventional art.
Figure 4:
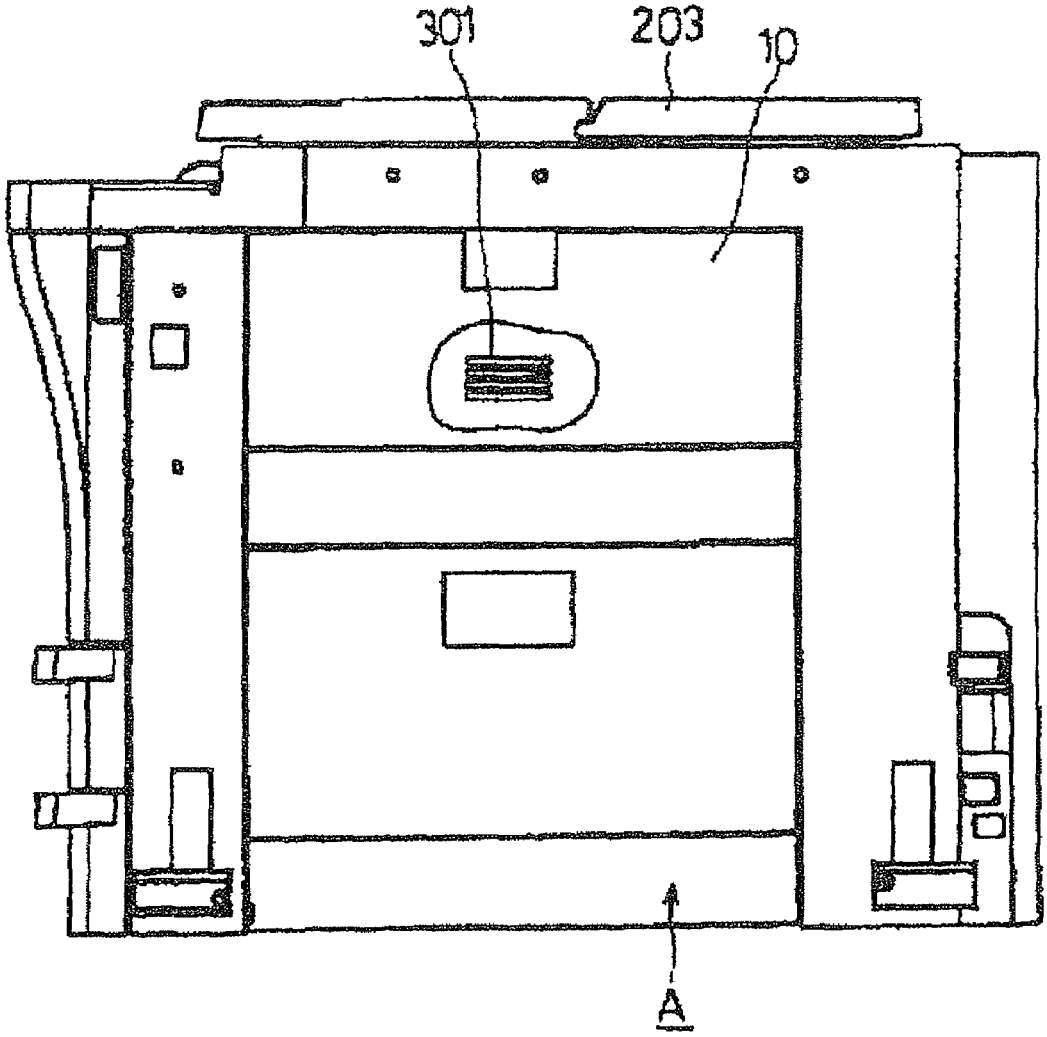
(Prior Art) Fig. 4
FIG. 4 is a figure explaining an image forming device according to conventional art.

For example, as shown in FIG. 2, the present invention can be applied to an image forming device in which the carriage C8 on which the lamp C6 and mirror C7 are mounted moves in the direction of the arrow shown in FIG. 2, to read the original document on the glass C4. To apply the present invention to this type of image forming device, the paper C1 impregnated with colored material may be positioned between the glass C4 and the white standard plate C5 positioned near the glass C4. Then by simply moving the carriage C8 in the direction of the arrow X the white standard plate, the colored material, and the original document can be read.

The image forming device according to the present invention can be applied to copiers, printers, facsimile machines, and similar for which it is necessary that good images be formed without transfer or separation defects.

What is claimed is:

1. An image forming device in which the conditions for specific processes are changed in accordance with the humidity, comprising:

colored material means having a color that changes with humidity;

a white standard plate;

detecting means for detecting the color of the colored material; and control means for changing the conditions for specific processes in accordance with the color, the colored material being provided between a reading position of the white standard plate and an original document irradiation position.

2. The image forming device according to claim 1, wherein the white standard plate has a known reflectivity and is provided below a glass provided on a top surface of a main body of the image forming device.

3. An image forming device in which the conditions for specific processes are changed in accordance with the humidity, comprising:

a colored material having a color that changes with humidity;

a white standard plate;

a color detector detecting the color of the colored material; and a control device changing the conditions for specific processes in accordance with the color, the colored material being provided between a reading position of the white standard plate and an original document irradiation position.

4. The image forming device according to claim 3, wherein the white standard plate has a known reflectivity and is provided below a glass provided on a top surface of a main body of the image forming device.

* * * * *